US008104611B2

(12) United States Patent
Helou, Jr.

(10) Patent No.: US 8,104,611 B2
(45) Date of Patent: Jan. 31, 2012

(54) MIXING CONTAINER AND METHOD OF FILLING

(76) Inventor: Elie Helou, Jr., Carpinteria, CA (US)

( * ) Notice: Subject to any disclaimer, the term of this patent is extended or adjusted under 35 U.S.C. 154(b) by 472 days.

(21) Appl. No.: 11/836,699

(22) Filed: Aug. 9, 2007

(65) Prior Publication Data

US 2010/0018880 A1 Jan. 28, 2010

(51) Int. Cl.
*B65D 81/32* (2006.01)
*B65D 25/08* (2006.01)

(52) U.S. Cl. ..... 206/219; 206/221; 215/6

(58) Field of Classification Search ..... 206/219–222, 206/568, 804; 220/506, 522, 521; 222/129, 222/142.5; 141/9; 215/DIG. 8, 6
See application file for complete search history.

(56) References Cited

U.S. PATENT DOCUMENTS

| | | | | | |
|---|---|---|---|---|---|
| 933,444 | A | | 9/1909 | Henke, Jr. | 220/506 |
| 1,706,335 | A | | 3/1929 | Toch | 220/506 |
| 2,661,870 | A | | 12/1953 | Huenergardt | 222/129 |
| 2,661,871 | A | | 12/1953 | Huenergardt | 222/129 |
| 2,884,149 | A | * | 4/1959 | Zimmermann et al. | 215/231 |
| 3,076,573 | A | | 2/1963 | Thomas | |
| 3,169,654 | A | * | 2/1965 | Pollklesener | 215/231 |
| 3,275,180 | A | * | 9/1966 | Optner et al. | 206/521 |
| 3,459,295 | A | | 8/1969 | Cousar | 215/6 |
| 3,696,919 | A | | 10/1972 | Miles | 215/6 |
| 3,705,661 | A | | 12/1972 | Davis | |
| 3,743,520 | A | | 7/1973 | Croner | |
| 3,819,081 | A | * | 6/1974 | Runte | 220/23.87 |
| 3,856,138 | A | | 12/1974 | Maekawa et al. | 206/221 |
| 4,215,786 | A | * | 8/1980 | Vertes | 215/231 |
| 4,279,349 | A | | 7/1981 | Aigner | |
| 4,410,085 | A | | 10/1983 | Beneziat et al. | 206/217 |
| 4,585,150 | A | | 4/1986 | Beacham et al. | 222/129 |
| 4,762,224 | A | | 8/1988 | Hall | 206/221 |
| 4,765,514 | A | | 8/1988 | Berglund | 222/145 |
| 4,805,789 | A | * | 2/1989 | Lancesseur et al. | 215/6 |
| 4,808,006 | A | | 2/1989 | Kauffler | |
| 4,915,255 | A | * | 4/1990 | Curtis | 220/23.89 |
| 4,950,237 | A | | 8/1990 | Henault et al. | |
| 4,993,595 | A | | 2/1991 | Bertram et al. | 222/129 |
| 5,060,791 | A | | 10/1991 | Zulauf | |

(Continued)

FOREIGN PATENT DOCUMENTS

| | | |
|---|---|---|
| EP | 0 060 401 | 9/1982 |

*Primary Examiner* — Steven A. Reynolds
(74) *Attorney, Agent, or Firm* — Connolly Bove Lodge & Hutz LLP

(57) ABSTRACT

A mixing container having an outer vessel with an open mouth and an inner vessel also with an open mouth separately stores two liquids for automatic mixing when the container is opened. Upon assembly, an interior seal between the open mouth of the inner vessel and the bottom of the outer vessel is effected through placement of a closure in the open mouth of the outer vessel. The inner vessel is received by a socket mounted in the closure which provides a resilient bias on the inner vessel to force the open mouth of the inner vessel against the bottom. A method for filling the mixing container includes a filling of the inner vessel, placement of the outer vessel over the inner vessel, immersing at least the open mouth of the outer vessel into a second liquid and evacuating the outer vessel. The mixing container may then be closed to resiliently bias the open mouth of the inner vessel against the bottom of the outer vessel to effect the interior seal.

21 Claims, 3 Drawing Sheets

U.S. PATENT DOCUMENTS

| | | | | |
|---|---|---|---|---|
| 5,114,411 | A * | 5/1992 | Haber et al. | 604/203 |
| 5,215,214 | A | 6/1993 | Lev et al. | 222/129 |
| 5,217,145 | A | 6/1993 | Haan et al. | |
| 5,316,146 | A * | 5/1994 | Graff | 206/438 |
| 5,352,196 | A * | 10/1994 | Haber et al. | 604/90 |
| 5,356,040 | A | 10/1994 | Reggiani | |
| 5,398,827 | A | 3/1995 | Armstrong et al. | |
| 5,447,226 | A | 9/1995 | Laine | |
| 5,769,680 | A * | 6/1998 | Hoffman | 446/75 |
| 6,464,078 | B1 * | 10/2002 | Grossnickle | 206/459.5 |
| 6,619,494 | B1 * | 9/2003 | Brozell et al. | 215/231 |
| 2004/0188281 | A1 * | 9/2004 | Iwasa et al. | 206/219 |
| 2007/0017831 | A1 * | 1/2007 | Kindt | 206/219 |
| 2009/0211927 | A1 * | 8/2009 | Wu | 206/219 |

* cited by examiner

MIXING CONTAINER AND METHOD OF FILLING

BACKGROUND OF THE INVENTION

The field of the present invention is multi-compartment mixing containers.

Containers are known for separately storing two liquids and automatically mixing the two liquids when the container is opened. Reference is made to one such example in U.S. Pat. No. 3,856,138. Such containers have utility when the combination of liquids will react or allow a deterioration of the combination.

Dual mixing containers which automatically mix liquids upon opening tend to be of complicated design. However, where beverages and other price sensitive products are to be mixed, inexpensive and uncomplicated mechanisms are needed to facilitate use, filling operations, sanitation, possible storage and competitiveness of packaging.

SUMMARY OF THE INVENTION

The present invention is directed to a mixing container employing an outer vessel and an inner vessel and a method for filling such a container. The vessels each have an end, an open mouth and a peripheral sidewall therebetween. An internal seal is defined by the bottom end of the outer vessel and the open mouth of the inner vessel when brought together. A closure is positionable to close the open mouth of the outer vessel. The invention provides for automatic mixing of liquids contained in the two vessels when the closure is removed. The method of filling provides for an inner vessel with one end closed.

In a first separate aspect of the present invention, the mixing container employs a socket which is resiliently mounted in the closure. The end of the inner vessel is mountable in the socket which, when assembled with the outer vessel, causes the inner vessel to be resiliently biased against the bottom of the outer vessel to define the interior seal.

In a second separate aspect of the present invention, the end of the inner vessel is a closed end. This feature allows the inner vessel to be filled independently without complicated mechanisms, sanitary complexity or extraordinary method steps.

In a third separate aspect of the present invention, a method of filling mixing containers includes filling the inner vessel separately and placing the outer vessel over the filled inner vessel with at least partial immersion of the outer vessel to then draw liquid into the outer vessel. The closure may then be fully assembled with the outer vessel. In the event a resiliently mounted socket is employed, the method may further include compressing the socket during closure.

In a fourth Separate aspect of the present invention, any of the foregoing aspects are contemplated to be combined to greater effect.

Accordingly, an improved mixing container and a method of filling are contemplated. Other and further objects and advantages will appear hereinafter.

DETAILED DESCRIPTION OF THE PREFERRED EMBODIMENTS

Figure 1:
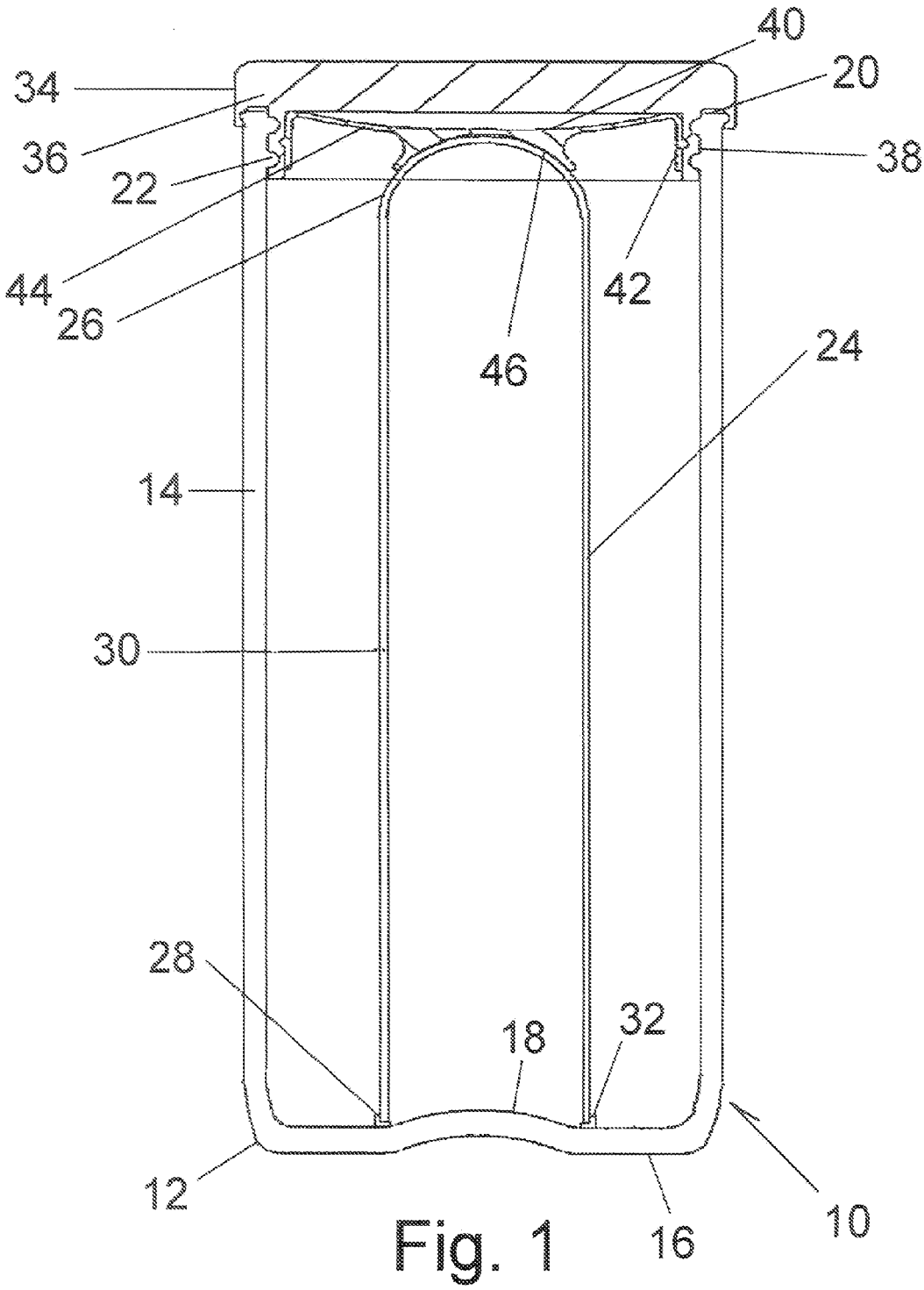
FIG. 1 is a cross-sectional side view of a mixing container.

Turing in detail to the drawings, FIG. 1 illustrates a mixing container, generally designated 10. The mixing container 10 includes an outer vessel 12 with a peripheral sidewall 14 which is conveniently cylindrical but may take on other shapes and configurations. A bottom 16 is at one end of the peripheral sidewall 14 and includes a raised surface 18 centrally mounted on the interior surface if the bottom 16 and having a circular periphery thereabout. An open mouth 20 is located at the other end of the peripheral sidewall 14 from the bottom 16. The open mouth 20 includes interior threads 22. Regardless of the configuration of the peripheral sidewall 14, if interior threads 22 are employed, the open mouth 20 is appropriately cylindrical. If a cork mechanism is employed as a closure, the interior threads 22 would not be employed.

An inner vessel 24 is illustrated to be in the form of a vial which is conveniently circular in lateral cross section. Again, other shapes may be appropriately employed for aesthetic considerations. The inner vessel 24 includes a closed end 26, an open mouth 28 and a peripheral sidewall 30 therebetween. A circular resilient seal 32 may be employed about the open mouth 28 of the inner vessel 24. The open mouth 28 with the circular resilient seal 32 is sized to fit about the raised surface 18 to effect an interior seal when the inner vessel 24 is assembled with the outer vessel 12. The fit between the raised surface 18 and the open mouth 28 of the inner vessel 24 may be enhanced with a more extreme rise to the surface 18 than shown where found necessary. The inner vessel 24 may be configured to establish a volumetric ratio to fit any given dual liquid product, such as through variation in the relative diameter of the inner vessel 24 relative to the outer vessel 12. The open mouth 20 of the outer vessel 12 should be large enough to accommodate passage of the inner vessel 24 therethrough.

A closure 34 is positionable to close the open mouth 20 of the outer vessel 12. The closure 34 has a cap 36 with a depending cylindrical body 38 having external threads to mate with the interior threads 22 of the outer vessel 12. The closure 34 is positionable to develop a conventional seal with the outer vessel 12 but is not called upon to seal the inner vessel 24. Both the outer vessel 12 and the inner vessel 24 are accessible only through the single open mouths 20, 28 of each.

A socket 40 is mounted within the interior of the closure 34, including a cylindrical flange 42 fitting within the cylindrical body 38 such that some force is required to extract the socket 40 from the closure 34 to assure retention of the inner vessel 24 for operation as described below. A bead and groove mechanism may increase the force required for extraction of the socket 40 from the closure 34 if necessary.

The socket 40 includes a circular dished plate spring 44 about which the cylindrical flange 42 extends. This plate spring 44 is positioned within the closure 34 such that the resilience of the spring is directed away from the cap 36. The socket 40 further includes a cavity 46 centrally located on the plate spring 44 to receive the closed end 26 of the inner vessel 24. The cavity 46 is intended to receive the closed end 26 and retain the inner vessel 24 through a mechanism such as adhesive, interference fit (if the socket extends down to the peripheral sidewall 30 of the inner vessel 24) or suction.

Figure 2:
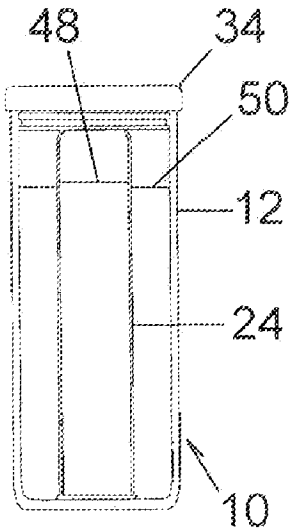
FIG. 2 is a transparent side view of the mixing container of FIG. 1 with liquids therein.

In use, the mixing container 10 is assembled with two different liquids 48, 50. One liquid 48 is contained within the inner vessel 24 while the other is contained within the outer vessel 12 in the annular space about the inner vessel 24. This arrangement is illustrated in FIG. 2.

The liquids 48, 50 best advantaged by the separation available with this container are those which will react with one another or allow deterioration when in combination. One example would be the preservative effect of alcohol in sufficient concentrations. When a flavorful drink that is used at an alcohol concentration below that required to preserve the flavor, one of the two liquids might be the diluting water while the other might be the flavored drink with a higher alcohol content. Where the liquid with high alcohol content contains oil, reducing the alcohol content with water through the mixing process can allow the oil to come out of solution and turn the mixture of the two liquids 48, 50 opaque.

The choice of which liquid goes in which vessel may be based on preference, relative volumetric need where the sizes of the two vessels 12, 24 are already configured, relative opacity or the physical needs of the liquids. Where one might desire to see the inner vessel 24, such as for labeling, the outer fluid would appropriately be transparent or at least sufficiently translucent for the inner vessel to be seen. Where one liquid is sensitive to being degraded by light over time, light shielding in the inner vessel 24 to accommodate that sensitivity with the sensitive liquid being in the inner vessel still allows viewing of the inner vessel 24 through a transparent or translucent outer vessel 12.

Figure 3:
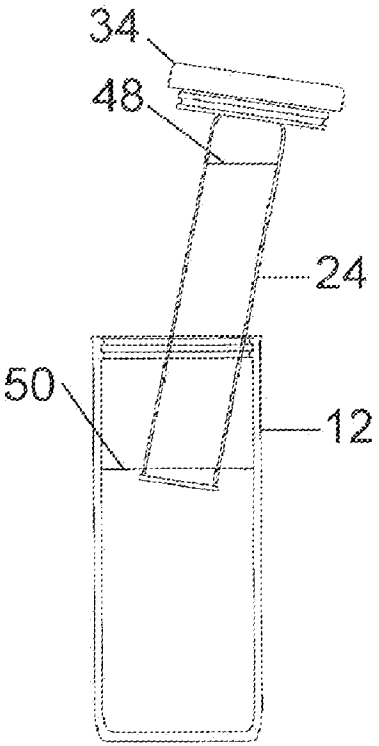
FIG. 3 is a transparent side view of the mixing container of FIG. 1 partially disassembled.

In FIG. 3, the closure 34 has been separated from the outer vessel 12 by unscrewing it therefrom. The closure 34, with the inner vessel 24 attached, is then lifted from the outer vessel 12. The liquid 48 primarily remains within the inner vessel 24 until the mouth 28 of the inner vessel 24 breaks the surface of the liquid 50. However, as the inner vessel 24 is withdrawn from the outer vessel 12, some mixing occurs. The amount of mixing depends to a certain extent on the size of the open mouth 28 of the vessel 24. Where the mixing before the open mouth 28 breaks the surface of the liquid 50 is greater than desired, a smaller mouth 28 can be employed regardless of the main diameter of the inner vessel.

Figure 5:
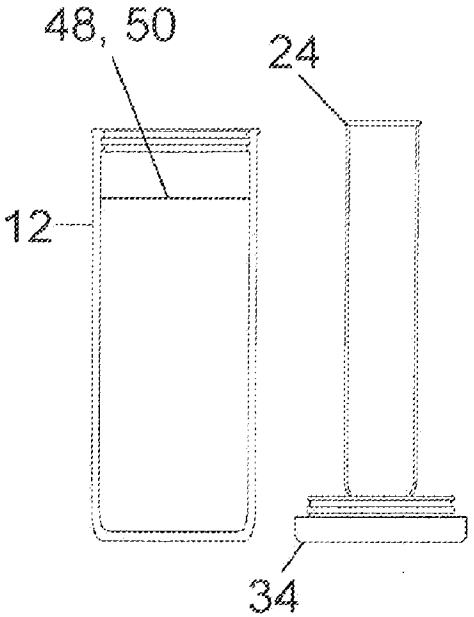
FIG. 5 is a transparent side view of the mixing container of FIG. 1 fully disassembled.
Figure 4:
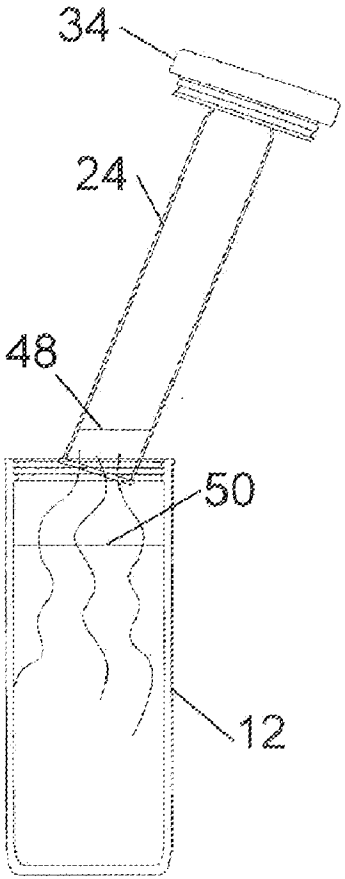
FIG. 4 is a transparent side view of the mixing container of FIG. 1 further partially disassembled.

When the open mouth 28 breaks the surface of the liquid 50, the liquid 48 rapidly drains from the inner vessel 24 unless the mouth 28 is severely constricted such that a more controlled mixing will occur. The open mouth 28 depicted in this embodiment is advantageous for rapid mixing that better assures a complete mixing of the liquids 48 and 50 when combined. This operation is depicted in FIGS. 3 and 4. FIG. 5 illustrates the inner vessel 24 removed from the outer vessel 12 and the liquids 48, 50 mixed within the outer vessel 12.

Figure 6:
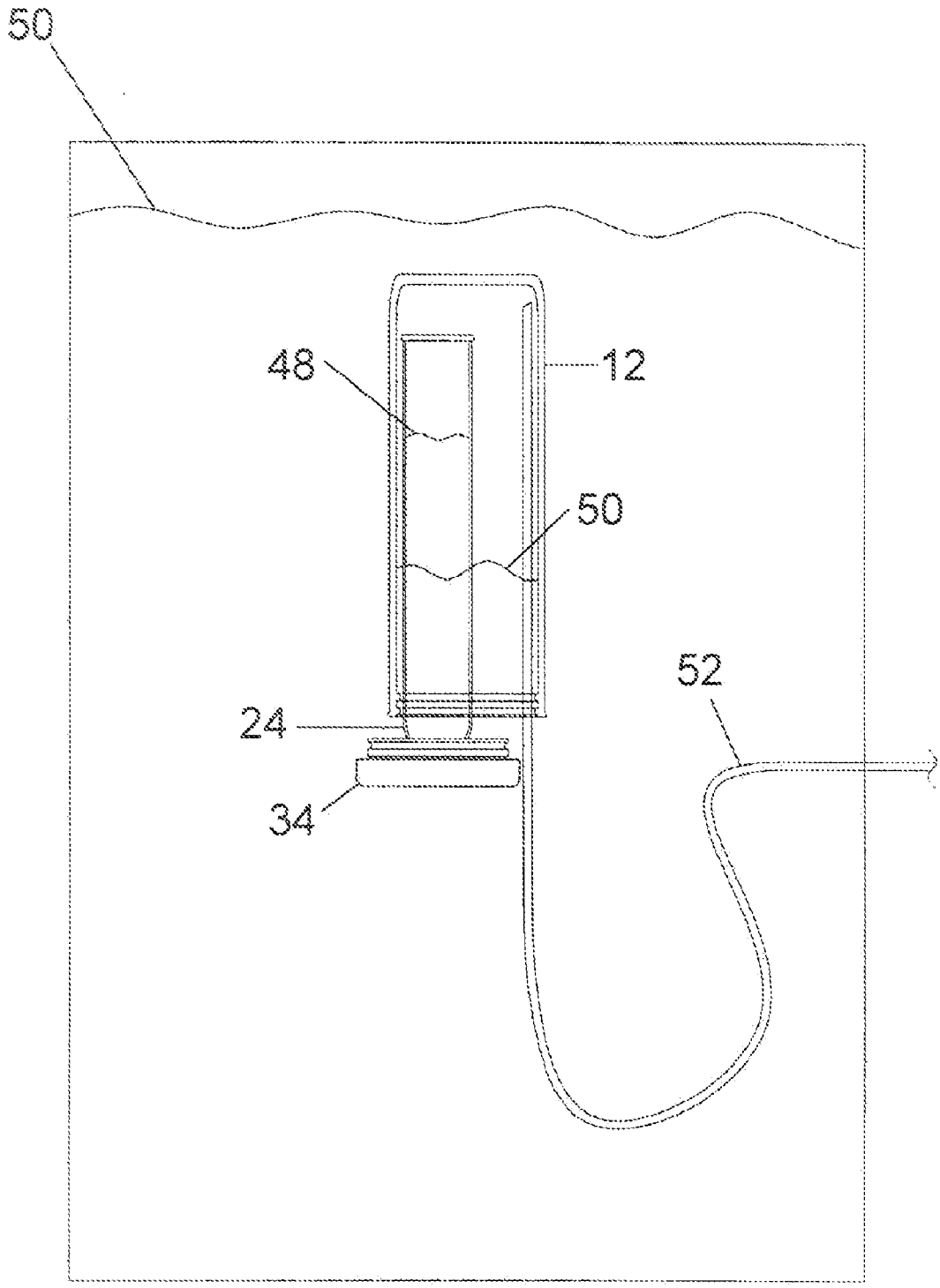
FIG. 6 is a transparent side view of the mixing container being filled with liquid.

Charging of the mixing container is illustrated in FIG. 6. The inner vessel 24 is filled with liquid to an appropriate height with the inner vessel 24 oriented such that the open mouth 28 facets upwardly. The inner vessel 24 is filled with the liquid 48 in that orientation. This step may occur just prior to association with the outer vessel 12 or may be accomplished in an assembly context where multiple such inner vessels 24 are filled and possibly even sealed pending assembly as part of the overall mixing container 10. The inner vessel 24 is associated, either before or after being filled with the liquid 48, with the socket 40 and with the closure 34. The step of filling and the step of associating the inner vessel 24 with the closure 34 need not occur in seriatim.

With the mouth 28 not closed by any temporary seal, the outer vessel 12 is placed over the inner vessel 24 while the inner vessel 24 remains in an orientation with the open mouth 28 facing upwardly. The closure is positioned such that it does not fully close the open mouth 20 of the outer vessel 12. This orientation is illustrated in FIG. 6.

A vacuum tube 52 is introduced into the outer vessel 12 either before or after the outer vessel 12 is placed over the inner vessel 24. This vacuum tube 52 is extended upwardly to above the intended level of fill of the outer tube 12 with the liquid 50. The open mouth 20 of the outer vessel 12 is immersed in the liquid 50 and vacuum is induced through the vacuum tube 52. The entire assembly may be submerged in the liquid 50. However, it is only needed that the outer vessel 12 be immersed into the liquid 50 to the point that the open mouth 20 be covered by the liquid 50.

The liquid 50 is then drawn into the outer vessel 12 to a level desired by evacuating at least some of the air or other gas within the outer vessel 12. To avoid any mixing of the liquids 48 and 50, the level of fill of the liquid 50 should be below the open mouth 28 of the inner vessel 24. Once the outer vessel 12 is filled, the vacuum tube 52 may be withdrawn from the container.

With the open mouth 20 of the outer vessel 12 still immersed in the liquid 50, the closure 34 is threaded into the open mouth 20 of the outer vessel 12 to close the outer vessel 12. The inner vessel 24 is of an appropriate length such that the open mouth 28 of the inner vessel 24 will contact the bottom 16 of the outer vessel 12 as the closure 34 is being installed. As the closure 34 is threaded into the outer vessel 12, the dished plate spring 44 is compressed to resiliently bias the open mouth 28 of the inner vessel 24 against the bottom 16 about the raised surface 18 to effect an interior seal. Once fully assembled, the mixing container 10 can then be inverted with the closure 34 on top ready for removal and liquid mixing.

The employment of the dished plate spring accommodates variation in manufacturing tolerances, thermal expansion and the like. The closed end 26 of the inner vessel 24 allows preloading and easy mating with the closure 34. Once the mixing container is charged, the simple interior seal may then be employed to separate the liquids until automatic mixing for use. The filling process disclosed also facilitates the employment of the uncomplicated design.

Thus, an improved mixing container is disclosed. While embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. A mixing container comprising:

an outer vessel having a bottom, an open mouth and a peripheral sidewall between the open mouth and the bottom;

an inner vessel having an end, an open mouth and a peripheral sidewall between the end and the open mouth;

a seal; and a closure positionable to close the open mouth of the outer vessel and form an exterior seal between the closure and open mouth of the outer vessel, the closure being attached to the end of the inner vessel, the closure and inner vessel being rigidly fixed to one another;

wherein the open mouth of the inner vessel is biased against a portion of the seal that is disposed between the open mouth of the inner vessel and the bottom of the outer vessel to effectuate an interior seal between the inner and outer vessels when the closure is positioned to close the open mouth of the outer vessel; and wherein breaking of the exterior seal between the closure and the open mouth of the outer vessel breaks the interior seal between the inner and outer vessels.

2. The mixing container of claim 1, the seal having a circular periphery and the open mouth on the inner vessel being circular and fitting about the circular periphery.

3. The mixing container of claim 1, wherein the seal is a resilient seal.

4. The mixing container of claim 1, the closure being positionable only to dose the open mouth of the outer vessel.

5. The mixing container of claim 4, the end of the inner vessel being a dosed end with access provided to the inner vessel only through the open mouth of the inner vessel.

6. The mixing container of claim 5, the bottom of the outer vessel being a dosed bottom with access provided to the inner vessel only through the open mouth of the outer vessel.

7. The mixing container of claim 1, the outer vessel being transparent and the inner vessel having light shielding.

8. The mixing container of claim 1 further comprising a first liquid in the inner vessel;

a second liquid in the outer vessel, the second liquid being transparent or at least sufficiently translucent to allow the inner vessel to be seen.

9. The mixing container of claim 8, a mixture of the first liquid and the second liquid being opaque.

10. The mixing container of claim 1, wherein the seal is coupled to the bottom of the outer vessel.

11. The mixing container of claim 1, wherein the seal is coupled to the open mouth of the inner vessel.

12. A mixing container comprising:

an outer vessel having a bottom, an open mouth and a peripheral sidewall between the open mouth and the bottom;

an inner vessel having an end, an open mouth having an edge and a peripheral sidewall between the end and the open mouth; and a closure positionable to close the open mouth of the outer vessel and form an exterior seal between the closure and the open mouth of the outer vessel;

wherein the open mouth of the inner vessel is resiliently biased downwardly towards the bottom of the outer vessel to effect an interior seal when the mixing container is assembled; and wherein breaking of the exterior seal between the closure and the open mouth of the outer vessel breaks the interior seal between the inner and outer vessels.

13. The mixing container of claim 12, the closure being positionable only to close the open mouth of the outer container.

14. The mixing container of claim 13, the end of the inner vessel being a closed end with access provided to the inner vessel only through the open mouth of the inner vessel.

15. The mixing container of claim 14, the bottom of the outer vessel being a closed bottom with access provided to the inner vessel only through the open mouth of the outer vessel.

16. The mixing container of claim 12, the outer vessel being transparent and the inner vessel having light shielding.

17. The mixing container of claim 12, further comprising a seal coupling the edge of the open mouth of the inner vessel and the bottom of the outer vessel.

18. The mixing container of claim 17, wherein at least a portion of the seal is disposed between the edge of the open mouth of the inner vessel and the bottom of the outer vessel to effectuate the interior seal when the open mouth of the inner vessel is resiliently biased downwardly toward the bottom of the outer vessel.

19. The mixing container of claim 12, further comprising a first component in the inner vessel and a second component in the outer vessel, wherein removal of the closure from the open mouth of the outer vessel causes the first and second components to combine.

20. The mixing container of claim 12, further comprising a socket mounted in the closure, the end of the inner vessel being mountable in the socket.

21. The mixing container of claim 20, wherein the socket comprises a circular dished plate spring retained within the closure and a cavity centrally located on the circular dished plate and receiving the end of the inner vessel.

* * * * *